US010433375B2

(12) United States Patent
Lomp et al.

(10) Patent No.: US 10,433,375 B2
(45) Date of Patent: Oct. 1, 2019

(54) INDUCTION HOB AND METHOD FOR CONTROLLING AN INDUCTION HOB

(71) Applicant: E.G.O. Elektro-Geraetebau GmbH, Oberderdingen (DE)

(72) Inventors: Stephane Lomp, Oberderdingen (DE); Michael Rupp, Eppingen (DE); Timo Dalaker, Oberderdingen (DE); Michael Stoeffler, Maulbronn (DE); Hartmut Friedrich, Knittlingen (DE); Christian Egenter, Bretten (DE); Wolfgang Mohr, Oelbronn-Duerrn (DE); Michael Eberle, Oberderdingen (DE); Thorsten Grunow, Stuttgart (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 874 days.

(21) Appl. No.: 14/951,182

(22) Filed: Nov. 24, 2015

(65) Prior Publication Data

US 2016/0150600 A1 May 26, 2016

(30) Foreign Application Priority Data

Nov. 25, 2014 (DE) ..... 10 2014 224 051

(51) Int. Cl.
*H05B 6/36* (2006.01)
*H05B 6/12* (2006.01)
*H05B 6/06* (2006.01)

(52) U.S. Cl.
CPC ..... *H05B 6/36* (2013.01); *H05B 6/062* (2013.01); *H05B 6/065* (2013.01); (Continued)

(58) Field of Classification Search
CPC ..... H05B 6/062; H05B 6/36; H05B 6/065; H05B 2213/03; H05B 2213/07; H05B 2213/05
(Continued)

(56) References Cited

U.S. PATENT DOCUMENTS

2001/0052519 A1 12/2001 Engelmann et al.
2010/0181304 A1* 7/2010 Gutierrez ..... H05B 6/065 219/626
(Continued)

FOREIGN PATENT DOCUMENTS

DE 202006016551 U1 4/2008
DE 102006054973 A1 5/2008
(Continued)

OTHER PUBLICATIONS

European Patent Office, Extended European Search Report for Application No. 15193655.6, dated Apr. 12, 2016, 8 pages, Germany.

*Primary Examiner* — Quang T Van
(74) *Attorney, Agent, or Firm* — Alston & Bird LLP

(57) ABSTRACT

An induction hob has a hob plate, a plurality of induction heating coils arranged under the hob plate and a plurality of sensor coils arranged under the hob plate. The induction heating coils are rectangular, wherein at least two induction heating coils are arranged one behind the other and at least three induction heating coils are arranged one next to the other. Two adjacent induction heating coils form an adjacent region with one another in which the two induction heating coils lie with their adjacent sides. At least one sensor coil is arranged in each adjacent region, wherein precisely a single sensor coil is provided in a spacing direction from the one induction heating coil to the adjacent induction heating coil.

17 Claims, 2 Drawing Sheets

(52) U.S. Cl.
CPC ..... *H05B 2213/03* (2013.01); *H05B 2213/05* (2013.01); *H05B 2213/07* (2013.01)

(58) Field of Classification Search
USPC ..... 219/620–624, 626, 660, 661, 667; 363/21, 26, 41, 49, 97
See application file for complete search history.

(56) References Cited

U.S. PATENT DOCUMENTS

| | | | | |
|---|---|---|---|---|
| 2011/0233199 | A1* | 9/2011 | Garcia Jimenez ..... | H05B 6/065 219/661 |
| 2015/0008216 | A1* | 1/2015 | Pippia ..... | F24C 7/083 219/627 |
| 2016/0037585 | A1* | 2/2016 | Christiansen ..... | H05B 6/065 219/626 |

FOREIGN PATENT DOCUMENTS

| | | | |
|---|---|---|---|
| EP | 1154675 | A1 | 11/2001 |
| EP | 2034799 | A1 | 3/2009 |
| EP | 2312908 | A1 | 4/2011 |
| EP | 2670211 | A2 | 12/2013 |
| EP | 2670211 | A3 | 12/2013 |
| GB | 2389767 | A | 12/2003 |
| WO | WO 2013/118027 | A1 | 8/2013 |

* cited by examiner

INDUCTION HOB AND METHOD FOR CONTROLLING AN INDUCTION HOB

CROSS-REFERENCE TO RELATED APPLICATIONS

This application claims priority to German Application No. 10 2014 224 051.4, filed Nov. 25, 2014, the contents of which are hereby incorporated herein in its entirety by reference.

TECHNOLOGICAL FIELD

The invention relates to an induction hob and to a method for controlling such an induction hob.

BACKGROUND

In induction hobs it is technically already possible per se to use an induction heating coil to detect the presence of a pan above the induction heating coil or on a cooking zone defined by the induction heating coil, as long as the pan per se is at all suitable for inductive heating. However, in modern induction hobs, as corresponding to EP 2670211 A2, it is now possible to use a multiplicity of distributed induction heating coils to cook not only always with precisely one pan on precisely one cooking zone with precisely one induction heating coil. For this purpose, a multitude of significantly smaller induction heating coils are provided, for example five or seven of which then together form, as it were, a cooking zone for a pan and heat the pan given correspondingly sufficient coverage by said pan. However, since it is desired to be able to place the pans at any desired location on such an induction hob, it may, under certain circumstances, not be sufficient, given adjacent induction heating coils, to define said heating coils, as it were, as a heating zone which is to be operated jointly and then apply said heating coils with a common identical power level on the basis of the fact that it has been detected that a pan has been placed on them. For this reason, EP 2670211 A2 proposes providing additional sensors for detecting a pan and at the same time arranging a large number thereof distributed on the induction hob.

BRIEF SUMMARY

The invention is based on the problem of providing an initially specified induction hob and a method suitable for controlling same, with which hob and method problems from the prior art can be solved, and with which it is possible, in particular, to detect, with an acceptable level of expenditure, a place in which a pan is positioned on the induction hob and to use this to control the induction hob or the induction heating coils.

This problem is solved by means of an induction hob, and a method for controlling such an induction hob. Advantageous and preferred refinements of the invention are subject matter of the further claims and are explained in more detail below. In this context, some of the features are described only for the induction hob or only for the method for controlling same. However, irrespective thereof they can be understood as applying independently both to the induction hob and to the method. The wording of the claims is incorporated in the description through express reference.

There is provision that the induction hob has a hob plate and a plurality of induction heating coils which are arranged under the hob plate. Furthermore, a plurality of sensor coils are arranged under the hob plate. These sensor coils advantageously operate inductively in order to detect the presence of a pan above them.

According to the invention there is provision that the induction heating coils are embodied to be rectangular or approximately rectangular. They are advantageously slightly elongate, wherein their length is particularly advantageously 10% to a maximum of 50% greater than their width. The approximated rectangular shape has its origin in the fact that the coil turns cannot run entirely to the corners or are not to be bent. The radius at the corners can accordingly be between 1 cm and 3 cm, and under certain circumstances even 5 cm. Nevertheless, the shape is essentially rectangular or considered correspondingly. A basically similar rectangular induction heating coil is known from DE 20 2006 016 551 U1.

At least two induction heating coils are arranged one behind the other and at least three induction heating coils are arranged one next to the other. This therefore means that at least six induction heating coils are provided on the induction hob, and advantageously eight or ten.

Furthermore, according to the invention, two adjacent induction heating coils form an adjacent region with one another, wherein these two induction heating coils then lie with their adjacent sides in this adjacent region. Two adjacent induction heating coils are advantageously at a set distance from one another, that is to say a distance from their outermost coil turns or their coil turns which define the sides. This distance from one another can be between 1 cm and 3 cm. In each of these adjacent regions, at least one sensor coil is arranged or its centre point is arranged there, and the sensor coil is advantageously also somewhat wider than an adjacent region. Furthermore, precisely a single sensor coil is provided in a spacing direction from the one induction heating coil to the adjacent induction heating coil. This means, expressed in simplified terms, that although only a single sensor coil is provided between the two adjacent induction heating coils in this spacing direction and is advantageously arranged with its centre point between the two induction heating coils, two sensor coils can also be provided along the region between two adjacent induction heating coils. These two sensor coils can then be provided one next to the other, advantageously with the same orientation with respect to the two adjacent induction heating coils.

Therefore, planar coverage of the induction hob or the hob plate and thus of the cooking region with respect to pans placed thereon is possible with a limited number of sensor coils. In addition to the pan-detection function by means of the induction heating coil itself, which has been mentioned at the beginning, the individual sensor coils can thus serve to detect, with relatively fine coverage, the presence of a pan above them and therefore to permit, in the total evaluation of all the induction heating coils and of all the sensor coils, the determination as to where in each case a pan is placed and also how large it is. As a result of the fact that only a single sensor coil is provided in the spacing direction between two adjacent induction heating coils, but possibly a plurality thereof in the transverse direction with respect to this spacing direction, it is also possible to ensure that the induction heating coils lie relatively close one next to the other. It is therefore possible for them to form a common cooking zone for common operation for heating a large pan without large gaps between the induction heating coils.

Although more than two sensor coils could also be provided one next to the other in at least one adjacent region, in the transverse direction with respect to the spacing direction or along the adjacent side of the induction heating coils which form the adjacent region, this actually is appropriate only when relatively large induction heating coils with a length which is at least 50% greater than their width are actually used.

There is advantageously provision that the sensor coils are arranged, as it were, symmetrically or uniformly between the induction heating coils in the spacing direction. As a result, a centre point of a sensor coil particularly advantageously lies not only also in the adjacent region between two adjacent induction heating coils but also between the adjacent sides of the induction heating coils, preferably precisely centrally between these two adjacent sides.

In an advantageous, further refinement of the invention it is possible to provide that sensor coils are not only arranged between induction heating coils or in adjacent regions of adjacent induction heating coils, but rather sensor coils are also arranged in such a way that they run largely or completely above an induction heating coil. These sensor coils are preferably arranged here above a central region of an induction heating coil. Owing to their considerably smaller embodiment than an induction heating coil, said sensor coils then do not serve at all to sense the presence of a pan anywhere above the induction heating coil or to sense its partial or complete coverage by a pan. Instead, it is therefore also possible to determine, particularly when the sensor coil is arranged above the central region of the induction heating coil, whether proportionally significant coverage of the induction heating coil with a pan, for example 20% to 30% or even 40%, is present in the centre thereof or not. In the case first mentioned, it would then in fact be possible to draw the conclusion from this that the significant coverage of the induction heating coil is also present in the centre thereof, and this pan is thus to be heated, and the induction coil therefore goes into the heating mode. By evaluating further, in particular adjacent sensor coils, and the adjacent induction heating coils, it is then possible to determine whether this pan is also arranged above further induction heating coils or is arranged sufficiently above further induction coils which then also go into the heating mode, specifically with the same heating power as the first-mentioned induction heating coil. Similar considerations also apply for the second case. However, it can then be assumed that, in order to achieve this high degree of coverage, the pan which is placed partially above the induction heating coil must be an extremely large pan, which then has an even larger probability of also covering one of the adjacent induction heating coils. It must then be determined whether one of these induction heating coils is also to go into the heating mode.

In one refinement of the invention, the induction heating coils can be embodied in different ways, in particular be of different sizes. In another advantageous refinement, all the induction heating coils are embodied so as to be of equal size and/or even identical. This simplifies the manufacture and makes it less expensive. Furthermore, a planar induction hob can then easily be equipped with a number of induction heating coils. All the induction heating coils of an induction hob particularly advantageously have the same winding direction. As a result, in principle their installation orientation is also the same in each case. As a result of the certain distance also adjacent induction heating coils from one another and as a result of the advantageous use of conventional ferrite cores on the induction heating coils, it is possible to avoid negative effects from their influence on one another.

While it has been explained at the beginning that, in adjacent regions, two sensor coils can be arranged one next to the other along this adjacent region at two induction heating coils which are arranged adjacent to one another with their long sides, only a single sensor coil should be arranged in relatively short adjacent regions of induction heating coils which are arranged with their short sides adjacent to one another. This has proven sufficient within the scope of the invention for fine enough resolution of the detection of the presence of a pan placed on them. It is therefore also possible to reduce the expenditure on components. Precisely two sensor coils are advantageously provided in the relatively long adjacent regions.

On the one hand, it is advantageous if the sensor coils are distributed regularly and/or uniformly, in particular in relation to their respective abovementioned orientation towards a central region of induction heating coils and/or in adjacent regions between two adjacent induction heating coils. In the second case, the centre points of the sensor coils are advantageously located between two induction heating coils. Furthermore, it is possible to provide that the sensor coils are arranged on the short sides of the induction heating coils, oriented approximately centrally with respect to the short sides. Along the long sides of adjacent induction heating coils it is possible to provide that the one sensor coil arranged there or the plurality of sensor coils arranged there is/are shifted towards a central region of the induction hob or away from an outer region or outer edge of the induction hob, for example by 5% to 25% of their actually symmetrical or uniform arrangement. This takes into account the fact that coverage of an induction heating coil in the outer region or near to the outer edge of the induction hob is rarer and, if it occurs, is brought about by a pan, with the result that detection even further towards the outer region is actually not necessary. An operator will hardly arrange a pan partially towards the outside projecting beyond the outer region of the induction hob and partially so as to cover an induction heating coil from the edge and at the same time wish that this pan is heated. The heating operation is to take place even if this occurs to such an extent that a substantial proportion of the induction heating coil of, for example, 30% to 50% is covered and possibly also even a sensor coil arranged in a central region of this induction heating coil is covered. As a result of the shifting of the sensor coils away from the edge region or towards a central region of the induction hob it is possible to improve the density of the sensor coils, and therefore the detection accuracy, there given a number of components which stay the same.

In one advantageous refinement of the invention there is provision that the sensor coils have a round shape, in particular a circular shape. This originates, in particular, from the fact that, in contrast to the induction heating coils, the geometric shape of said sensor coils does not play a significant role and this round shape permits simple manufacture. A sensor coil can have, for example, 10 to 40 turns. Its diameter can be between 1 cm or 2 cm and 5 cm.

The sensor coils preferably run at least partially above the induction heating coils or are arranged thereabove; they therefore run in particular at a higher plane. The sensor coils can be positioned on the induction heating coils, but do not have to be. They are advantageously attached independently of the induction heating coils, or not by being positioned on the induction heating coils but rather on a further carrier device. This further carrier device is, for example, a planar carrier plate or a carrier film, which can be attached to the underside of the hob plate, or else simply positioned on the rest of the induction hob or its induction heating coils which form the uppermost region or the upper side of the substructure of the induction hob. In addition to mechanical attachment to such a carrier device, electrical contact can also be formed via the latter.

The sensor coils which are arranged centrally above an induction heating coil can essentially run in a region in which the induction heating coil does not have any coil turns in its centre. The sensor coils which are arranged in the adjacent regions overlap the induction heating coils or the edge regions thereof advantageously uniformly and in the same way. This originates, in particular, from the fact that for a good function the sensor coils preferably have to be wider than the width of a distance or intermediate region between adjacent induction heating coils.

In one advantageous embodiment of the invention, the induction heating coils can have a single layer of turns, or their turns can run in a single layer and therefore a single plane. This is advantageously parallel to the hob plate and also parallel to a layer or plane in which the sensor coils run. In a similar form in principle, however independently thereof, in one alternative, the sensor coils can also be wound in a single layer, or their turns can run in a single layer or a single and advantageously common plane. The sensor coils are also advantageously embodied identically with respect to one another in order to reduce the expenditure on components. In another alternative, all the turns in a sensor coil have approximately the same diameter with deviations from a single wire thickness to 5 times the wire thickness. In this case, the turns form as it were a bundle with the smallest possible extension in the vertical direction and also in the diameter of the sensor coil. The geometrical extension of the bundle would be disadvantageous, and the higher inductance would be advantageous given a relatively small number of turns.

In an embodiment of the invention, one sensor coil or all sensor coils can be provided with a temperature sensor or carry such a temperature sensor. This can for example be in a central area or on a central point. Sensor coil and temperature sensor can form a constructional unit as one part, preferably also with one single electrical connector for ease of manufacture and electrical connection. The temperature sensor preferably is a temperature dependent resistor, for example a PT1000 temperature dependent resistor. The temperature sensor can be used together with the sensor coil to detect the placing of a pan on the hob plate above, if for example despite the heating operation of the induction heating coil no rise of temperature can be detected. In addition or alternatively, the temperature sensor can be used for regular operation as a residual heat display, for example.

In a method mentioned at the beginning for controlling an abovementioned induction hob there is provision that the sensor coils are continuously operated and/or are intended to continuously sense whether a pan is placed on the hob plate above them. This continuous operation is intended to indicate here that the sensor coils are not operated every second or continuously but rather, for example, in an interval operating mode or every few seconds, for example every 0.5 second to 30 seconds. The operation of an induction heating coil for heating a pan which is placed is, however, not intended to indicate that the sensor coils then do not have to operate any more. It is possible to provide that for the sake of simplicity all the sensor coils are operated advantageously continuously in an interval operating mode, that is to say, for example, all detect or attempt to detect every 0.5 second to 30 seconds, as mentioned above, whether a pan is placed above them. If a sensor coil is then adversely affected in its function by an induction heating coil which is operated directly below it or adjacently below it, this is not disruptive, since it is then possible to assume that a pan is placed on the induction heating coil, or sufficiently on the induction heating coil. Otherwise, owing to the induction heating coil's own operating conditions the induction heating coil would set the heating operation, in particular when a pan is not placed sufficiently or there is not sufficient coverage.

The resonant frequency of the sensor coils and of their evaluation circuit is advantageously significantly higher than the working frequency of the induction coils, preferably 5 times to 30 times higher. It is therefore possible for each to work better and they do not disrupt one another. An induction coil is particularly advantageously actuated to heat a pan only if at least one of the sensor coils is covered by a pan. The presence of a pan is then ensured.

Further advantageous aspects relating to control of the induction hob will be described in relation to the figures and can be explained better with reference to the figures.

These and further features emerge from the claims and also from the description and the drawings, and the individual features can each be implemented independently or together in the form of secondary combinations in one embodiment of the invention and in other fields, and can form advantageous embodiments which are capable of being protected in themselves and for which protection is applied here. The division of the application into individual sections and intermediate headings do not restrict the generality of the statements made under said headings.

BRIEF DESCRIPTION OF THE SEVERAL VIEWS OF THE DRAWINGS

Exemplary embodiments of the invention are illustrated schematically in the drawings and will be explained in more detail below. In the drawings.

DETAILED DESCRIPTION

Figure 1:
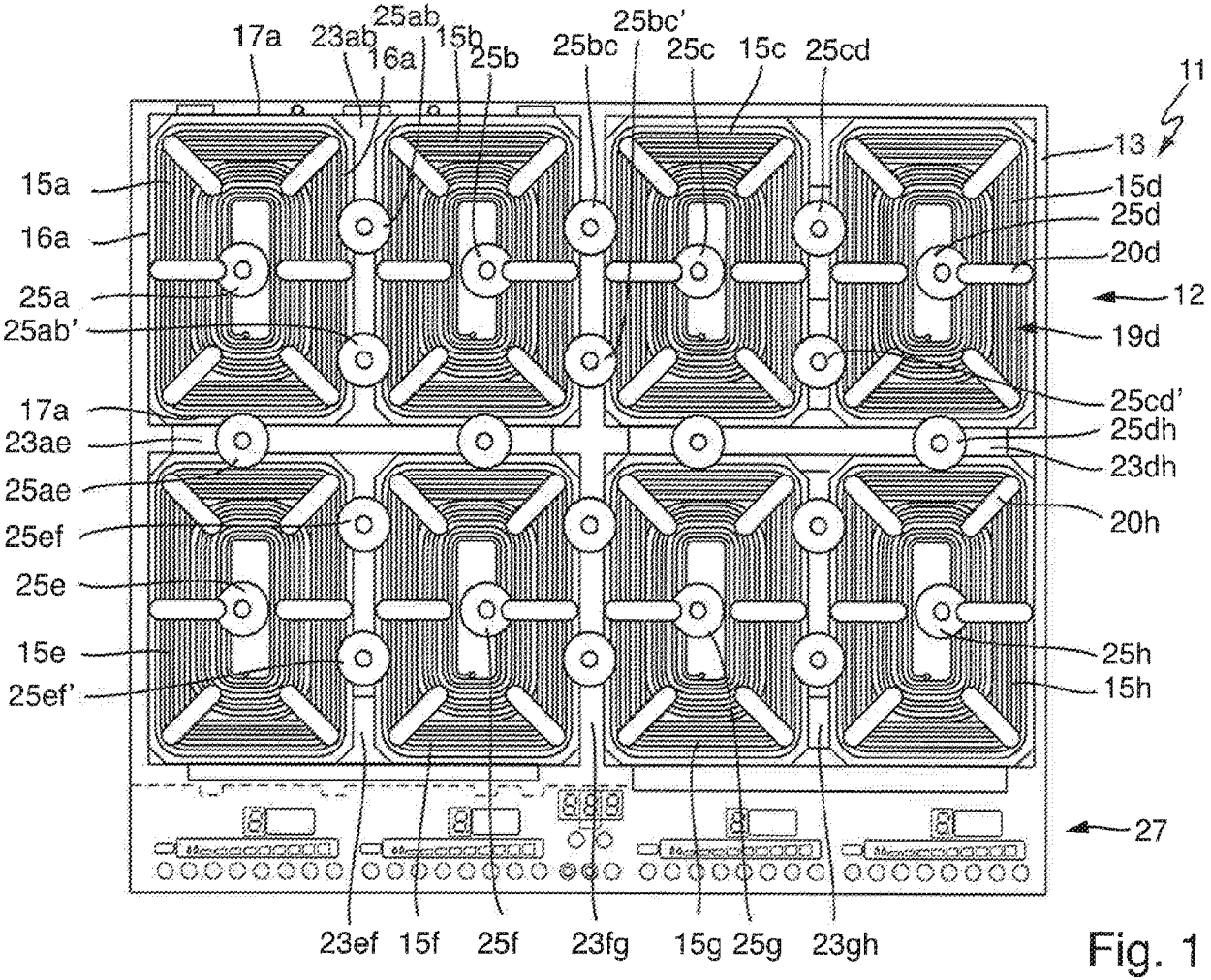
FIG. 1 shows a plan view of an induction hob according to the invention with the hob plate removed.

FIG. 1 shows an inventive induction hob 11 in a plan view, but with the hob plate removed, or without a hob plate, that is to say therefore a substructure 12. This substructure 12 can, as is shown, be connected to a hob plate essentially in a customary fashion. For this purpose, the substructure 12 has a carrier plate 13 which is then connected to the actual hob plate by securing means or the like.

Eight essentially rectangular induction heating coils 15*a* to 15*h* are arranged on the carrier plate 13. The induction heating coils 15 are all embodied identically and oriented in the same way, as can be detected at least in their central region at the point where a respective coil turn 19*a* to 19*h* leads off downwards to the electrical connection. The induction heating coils 15 each have long sides 16*a* to 16*h* and short sides 17*a* to 17*h*. At the corners they are somewhat rounded because of the better guidance of the outer coil turns 19, since they should not be bent. Nevertheless, induction heating coils with this shape will be considered below to be rectangular or at least approximately rectangular, as explained at the beginning.

Ferrite rods 20*a* to 20*h* are placed above the coil turns 19*a* to 19*h*. The coil turns 19*a* to 19*h* themselves are applied to coil carriers 21*a* to 21*h*, and these coil carriers 21 are then in turn arranged on the carrier plate 13.

It is apparent that the induction heating coils 15*a* to 15*h* are each at a certain distance from their adjacent coils, which distance can in practice be 1 cm to 3 cm or even 5 cm, wherein smaller distances are preferred. As a result, adjacent regions 23 are formed, typically adjacent regions between long sides 16 of the induction heating coils, specifically the adjacent regions 23*ab*, 23*bc*, 23*cd*, 23*ef*, 23*fg* and 23*gh*. These adjacent regions 23 are all of the same width and same length. Furthermore, the induction heating coils 15 form further adjacent regions, specifically the adjacent regions 23*ae*, 23*bf*, 23*cg* and 23*dh* at their short sides 17 which point towards one another or are adjacent. These four adjacent regions are also each of equal length and equal width. In the exemplary embodiment illustrated here they are somewhat wider than the long adjacent regions, but this does not play any large role.

Sensor coils 25 are arranged in the adjacent regions 23. These sensor coils 25 are embodied as described at the beginning, that is to say flat, single-turn or single-layer coils with a round shape with 10 turns to 30 turns. In each case two such sensor coils 25 are arranged in the long adjacent regions, specifically the sensor coils 25*ab*, 25*ab*', 25*bc*, 25*bc*', 25*cd* and 25*cd*' are arranged in the upper three long adjacent regions 23*ab*, 23*bc* and 23*cd*. In the three lower long adjacent regions 23*ef*, 23*fg* and 23*gh*, these are the sensor coils 25*ef*, 25*ef*, 25*fg*, 25*fg*', 25*gh* and 25*gh*'. In the case of these sensor coils 25 which are arranged in the long adjacent regions it is apparent that their centre point is arranged in each case precisely in the centre of the adjacent regions 23 or precisely between the adjacent induction heating coils 15 or their long sides 16. Otherwise, the sensor coils 25 overlap the induction heating coils 15 at their long sides 16, in each case by a certain amount, and specifically in the same way. There can be, in practice, one to three or four coil turns 19. Furthermore, although the sensor coils 25 in the long adjacent regions are arranged mirror-symmetrically with respect to an axis through the short adjacent regions, it is apparent that, for example in the upper region of the induction hob 11, the upper sensor coil 25*ab* is arranged further from the upper short sides 17*a* and 17*b* of the induction heating coils 15*a* and 15*b* than the lower sensor coil 25*ab*' is arranged from the lower short sides 17*a*' and 17*b*'. This difference can be several cm, but is clear. The shifting can be by several cm, for example 1 cm to 5 cm. Therefore, as mentioned at the beginning, the sensor coil density or detection accuracy in the central region of the entire induction hob 11 is improved compared to the upper and lower edge regions.

Sensor coils 25 are also arranged in the short adjacent regions 23*ae*, 23*bf*, 23*cg* and 23*dh*. These are also arranged precisely along a central longitudinal axis of the short adjacent regions, that is to say the respective upper and the respective lower induction heating coils 15 overlap uniformly, for example likewise with one to three coil turns. These sensor coils 25 also have a short offset from the central arrangement with respect to the induction heating coils, and the sensor coils 25*ae* and 25*cg* are therefore shifted somewhat to the left from the centre point of the short sides 17 of the respective adjacent induction heating coils 15. This shifting may have been by approximately 1 cm. The sensor coils 25*bf* and 25*dh* are, in contrast, shifted to the right by the same amount. This has also proven advantageous for the detection of placed pans within the scope of the invention.

Finally, sensor coils, specifically the sensor coils 25*a*, 25*b*, 25*c*, 25*d*, 25*e*, 25*f*, 25*g* and 25*h*, are also arranged in central regions of the induction heating coils 15. These sensor coils 25*a*, 25*b*, 25*c*, 25*d*, 25*e*, 25*f*, 25*g* and 25*h* are arranged oriented centrally with respect to the long sides 16 of the induction heating coils, but are shifted a small amount to the left or to the right from the centre of the short sides 17 in a way corresponding to the sensor coils 25*ae*, 25*bf*, 25*cg* and 25*dh* in the short adjacent regions 23.

All the sensor coils 25 are connected to a controller (not illustrated here) of the induction hob 11. A method for actuating the controller will be explained below. In the centre of the sensor coils, the above-mentioned temperature sensors are provided on their top side, shown as small circles. They can be for example PT 1000 temperature dependent resistors. The temperature sensor can be connected to a controller of the induction hob 11.

In the front region, the induction hob 11 has an operator region 27 with displays and operator control elements for setting the power for hobs, which are formed in various ways by one or more induction heating coils 15.

Figure 2:
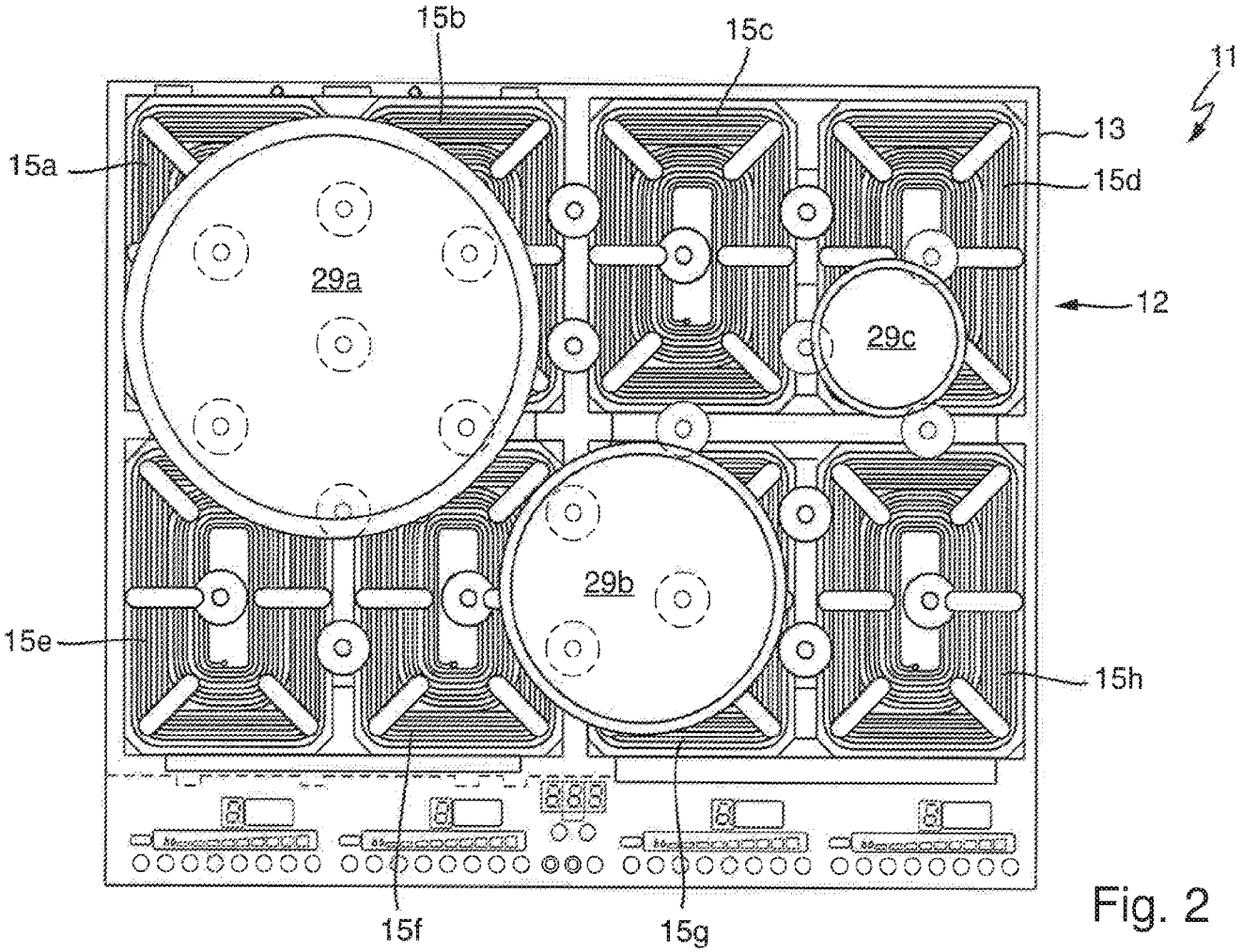
FIG. 2 shows a view of various configurations of pans on the induction hob from FIG. 1.

A plurality of possibilities for placed pans are illustrated in FIG. 2. A very large pan 29*a* is placed in the left-hand upper region, a medium-sized pan 29*b* is placed in the front central region and a small pan 29*c* is placed on the right at the top.

The pan 29*a* covers large regions of the induction heating coils 15*a* and 15*b* as well as small regions of the lower induction heating coils 15*e* and 15*f*. Furthermore, the sensor coils 25*ab*, 25*ab*', 25*ef*, 25*ae* and 25*bf* as well as 25*a* and 25*b* are fully covered. This means that these sensor coils primarily detect the presence of a placed pan above them. However, they do not detect that this pan is a single, as it were coherent pan which is to be heated jointly with the same heating power. For this reason, the coverage information of the induction heating coils 15 is also used. Since none of the sensor coils 25*e* or 25*ef*' which is otherwise also associated with the induction heating coil 15*e* detects the presence of a pan above it, but at the same time the sensor coils 25*fg* and 25*fg*' detect the presence of the central pan 29*b*, which explains the higher degree of coverage of the induction heating coil 15*f*, a controller of the induction hob 11 can conclude that just such a very large pan is placed and covers these seven sensor coils, that is to say it must be approximately the size of the large pan 29*a*. In this case, owing to the excessively small coverage of the lower induction heating coil 15*a* the latter is then not operated, nor is the adjacent induction heating coil 15*f*. The pan 29*a* is therefore heated only by means of the two upper induction heating coils 15*a* and 15*b*. Here, under certain circumstances the information could also even be output to an operator that the pan 29*a* should be shifted somewhat more over the two upper induction heating coils 15*a* and 15*b* so that it is heated more uniformly. However, this is an optional additional function. Conclusions about the pan material can also be drawn through more wide-ranging evaluation of the sensor signal.

Owing to the wide-ranging coverage of the induction heating coil 15*g* with complete coverage of the sensor coils 25*g*, 25*fg* and 25*fg*' as well as the partial coverage of the sensor coil 25*gh*' without coverage of the sensor coils 25*gh* and 25*g* as well as 25*e*, it is possible to infer the size of the pan 29*b*. Furthermore, the controller can also detect that this pan 29*b* partially projects over the induction heating coil 15*e*. Since the controller can, however, detect on the basis of the size and the arrangement of the pan 29*a* that the induction heating coil 15*f* is covered precisely to the same extent by the pan 29*a* as the induction coil 15*e*, it can detect that the overall, somewhat larger coverage of the induction heating coil 15*f* additionally occurs as a result of a part of the further pan 29*b*, but this portion is in turn too small to justify heating by the induction heating coil 15*f*. For this reason, the pan 29*b* is heated only with the induction heating coil 15*g*. Nevertheless, it is apparent that the overall degree of coverage of the induction heating coil 15*f* could in itself be sufficient to start a heating operation for a supposedly placed pan.

The induction heating coil 15*d* detects coverage of approximately 30% to 40%. At the same time, the sensor coils 25*d*, 25*cd*' and 25*dh* detect a partial coverage. However, the induction heating coils 15*c* and 15*h* do not have any coverage at all. It is therefore apparent that a pan is positioned only over the induction heating coil 15*d*, and also that its approximate size can be detected. Since such small pans are also to be heated inductively with the induction hob 11, the induction heating coil 15*d* then actually starts the heating operation for the pan 29*c* with a power level which is input at the operator region 27.

From FIG. 2 it is apparent, on the basis of the explanation relating to the large pan 29*a* top left, that the coverage information of the induction heating coils 15, on the one hand, and of the affected sensor coils 25, on the other, necessarily signifies the presence of a single pan, and also approximately with this size. If the pan 29*a* were even larger with the same placed centre point, it would very quickly cover the sensor coil 25*bc*' and therefore give rise to a signal at it. If it were even larger, but, as it were, shifted somewhat to the left and upwards, so that its degree of coverage of the induction heating coils 15*a* and 15*b* would be larger, this would still signify the same heating mode, specifically only by means of the induction heating coils 15*a* and 15*b*, which then together form a cooking zone for this pan. If the pan 29*a* were not circular but instead elongate in the manner of a roasting pan, it could only be larger without coverage of additional sensor coils 25 in the downwards direction, that is to say to a greater extent over the induction heating coils 15*e* and 15*f*. However, its degree of coverage would then increase or one of the sensor coils 25*e*, 25*f* or 25*ef*' would detect the presence of a pan above it. If a certain degree of coverage of the induction heating coils is reached, or at the latest when one of the specified sensor coils is covered, additional operation of the induction heating coils 15*e* and 15*f* would, however, then also be justified.

Furthermore, it is, for example, also clearly apparent that the coverage of the sensor coil 25*ef* in the case of such small coverage of the induction heating coils 15*e* and 15*f* as well as of the sensor coils 25*ae* and 25*bf* necessarily means that the sensor coil 25*ef* is covered by the same pan. Although the coverage with a very small pan, placed essentially centrally over the sensor coil 25*ef*, would in principle also be possible, the sensor coils 25*ae* and 25*bf* could then no longer be covered, unless, in turn, by very small pans. However, given coverage of the other four sensor coils by the pan 29*a*, this would then again not justify the overall large degree of coverage on the induction heating coils 15*a* and 15*b*. Furthermore, as explained at the beginning, all the coverage information of all the induction heating coils 15 and all the sensor coils 25 is continuously evaluated, and the additional degree of coverage of the induction heating coil 15*f* caused by the pan 29*b* can also be explained by the detection of this pan.

Furthermore it is also apparent that the coverage by the two pans 29*a* and 29*b* cannot take place by means of a single large pan. Otherwise, the coverage of the induction heating coil 15*f* would be larger, and also the induction heating coil 15*c* would have to have at least a small degree of coverage, as would also in particular the sensor coils 25*bc*' and 25*f*, but they are not covered at all. The same also applies to the sensor coil 25*cg*.

That which is claimed:

1. An induction hob comprising:

a hob plate;

a plurality of induction heating coils arranged under said hob plate; and a plurality of sensor coils arranged under said hob plate, said plurality of sensor coils being wound with turns running in a single and common plane, said single and common plane being above a location of said plurality of induction heating coils, wherein:

said induction heating coils are embodied to be rectangular or approximately rectangular;

at least two of said induction heating coils are arranged one behind the other and at least three of said induction heating coils are arranged one next to the other;

two adjacent of said induction heating coils form an adjacent region with one another, wherein said two induction heating coils lie with sides adjacent to each other in said adjacent region;

at least one sensor coil is arranged in each said adjacent region; and precisely one single of said sensor coils is provided in a spacing direction from one of said induction heating coils to adjacent one of said induction heating coils.

2. The induction hob according to claim 1, wherein at least two said sensor coils are provided one next to another along said adjacent sides of said induction heating coils in at least one said adjacent region.

3. The induction hob according to claim 1, wherein a centre point of one of said sensor coils lies between two of said adjacent sides of said induction heating coils.

4. The induction hob according to claim 1, wherein one of said sensor coils is arranged above a central region of one of said induction heating coils.

5. The induction hob according to claim 1, wherein all said induction heating coils are embodied so as to be of equal size.

6. The induction hob according to claim 1, wherein all said induction heating coils have a same winding direction.

7. The induction hob according to claim 1, wherein precisely one single sensor coil is arranged in adjacent regions on two of said induction heating coils being arranged with their short sides adjacent to one another.

8. The induction hob according to claim 7, wherein precisely two sensor coils are provided in adjacent regions between two induction heating coils being arranged with their long sides adjacent to one another.

9. The induction hob according to claim 1, wherein said sensor coils are not distributed uniformly or symmetrically along said long sides, but rather are shifted towards a central region of said induction hob, and away from an edge of said induction hob.

10. The induction hob according to claim 1, wherein, in adjacent regions between two of said adjacent induction heating coils in which only single of said sensor coils is provided, said sensor coil is arranged centrally with respect to said longitudinal sides of said induction heating coil running in said adjacent regions.

11. The induction hob according to claim 1, wherein said sensor coils have a round shape.

12. The induction hob according to claim 11, wherein said sensor coils have ten to forty turns.

13. The induction hob according to claim 1, wherein said sensor coils overlap said induction heating coils uniformly and to a same degree in the same way.

14. The induction hob according to claim 1, wherein said induction heating coils have a single layer of turns, or said turns run in a single layer.

15. The induction hob according to claim 1, wherein said sensor coils are wound in a single layer and turns of said sensor coils run in a single layer.

16. The induction hob according to claim 1, wherein said sensor coils are provided with a temperature sensor in their central area.

17. The induction hob according to claim 16, wherein said temperature sensor is a temperature dependent resistor.

* * * * *